United States Patent [19]

Coons, III

[11] Patent Number: 4,841,606

[45] Date of Patent: Jun. 27, 1989

[54] NOTCHED GUIDE FILAMENT YARN INTERLACER

[75] Inventor: Andrew M. Coons, III, Anderson, S.C.

[73] Assignee: BASF Corporation, Williamsburg, Va.

[21] Appl. No.: 220,042

[22] Filed: Jul. 15, 1988

[51] Int. Cl.[4] ..... D02J 1/08
[52] U.S. Cl. ..... 28/274
[58] Field of Search ..... 28/271, 272, 274, 275, 28/276

[56] References Cited

U.S. PATENT DOCUMENTS

| | | | |
|---|---|---|---|
| 4,223,520 | 9/1980 | Whitted et al. | 28/276 X |
| 4,240,188 | 12/1980 | Zoina | 28/274 |
| 4,592,119 | 6/1986 | Bauer et al. | 28/274 X |
| 4,621,490 | 11/1986 | Kawabata et al. | 57/350 X |

FOREIGN PATENT DOCUMENTS

| | | | |
|---|---|---|---|
| 49-12145 | 2/1974 | Japan | 28/271 |
| 62-177249 | 8/1987 | Japan | 28/271 |

*Primary Examiner*—Robert R. Mackey
*Attorney, Agent, or Firm*—Tom R. Vestal

[57] ABSTRACT

Disclosed is a fluid jet interlacing device for commingling yarns. The interlacing device features notches in the inlet and exit orifices which provide for better wear resistance and evenness between related devices.

6 Claims, 1 Drawing Sheet

NOTCHED GUIDE FILAMENT YARN INTERLACER

BACKGROUND OF THE INVENTION

Jet interlacers of natural and synthetic fibers are known. In U.S. Pat. No. 2,884,756, for example, there is disclosed an apparatus and process for producing a bulked yarn, wherein a smooth or flat yarn is drawn in from the side (see FIG. 3 therein) into an aspirator-type device. The yarn is withdrawn from the device at a lesser speed, whereby the action of fluid within the aspirator zone causes the individual filaments of the yarn therein to form small loops and the filaments bind among themselves. As noted at column 3, the yarn is withdrawn from the device at an abrupt angle. The device in U.S. Pat. No. 2,997,771 is similar in design and operation, but has an even greater flared exit orifice. See also U.S. Pat. No. 3,103,731.

U.S. Pat. No. 3,026,597 is an example of an interlacing/texturing jet in which the fluid for interlacing-/texturing enters from one side of the yarn conduit. In this device, the yarn conduit or passage is tapered uniformly from the inlet end to its exit. The fluid passage communicates with the yarn passage about midway through the device. See also U.S. Pat. No. 3,665,566 for another example of side entry fluid inlets.

U.S. Pat. No. 3,574,249 describes a yarn threadline treating apparatus including a series of guides for the threadline associated with a fluid withdrawal enclosure. U.S. Pat. No. 4,188,692 describes an air jet device having alternate inlets to the yarn passageway and an angled air inlet.

U.S. Pat. Nos. 3,846,968 and 4,223,520 are typical of the use of such devices as air jets to entangle multiple ends of synthetic filaments. U.S. Pat. No. 4,318,210 reflects the use of a hot air device for hot drawing yarn drawn at an angle over pins 12. Finally, U.S. Pat. No. 4,570,312 describes a method and process for air entangling a plurality of yarn ends.

It is a characteristic of these devices, regardless of the materials of construction, to ultimately wear due to continual passage of yarns through the device under varying amounts of frictional forces. In the somewhat random nature of contacting the yarn filaments with the jet surface, wear from device to device is uneven, and much care and exercise must be taken to prevent the inconsistencies in wear from being translated into inconsistencies in the entangled product being made.

This is especially true for jets in which yarn is fed thereto in angled relationship to the yarn passage. The tensions created in dragging the yarn through the jet entrance lowers the entangling performance of the jet.

THE PRESENT INVENTION

The improvement of this invention in such devices comprises the addition of a means for eliminating or substantially reducing the variations in consistency from position to position. The means provides for greater uniformity in tension or drag levels through the air jet device. Furthermore, the means serves as an aid for guiding yarns into the yarn passageway of the jet. It serves to increase the life expectancy of the air jet by minimizing tension drag variations over a longer period than devices heretofore known.

The invention comprises placement of a small notch or slot in the entrance and exit sections of the yarn passage in the area where the yarn will contact the jet.

More detailed descriptions of the invention may be seen in reference to the drawings in which:

DETAILED DESCRIPTION OF THE DRAWINGS

Figure 1:
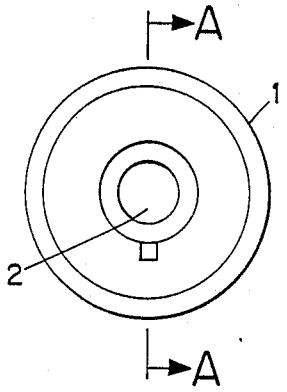
FIG. 1 represents an end view of an air jet of the design of the invention.

FIG. 1 depicts a conventional air jet housing 1 having a yarn passageway 2 comprising two concentric cylindrical bores 3 and 4 of different diameters and end to end. An air inlet 5 of lesser diameter (see FIG. 2) intersects the larger cylindrical passage bore 4 perpendicular to the yarn passage. Yarn threaded through the passageway normally enters the larger bore 4. Air or other fluid from a supply not shown enters the yarn passageway in a manner similar to that disclosed in the references cited herein.

Figure 2:
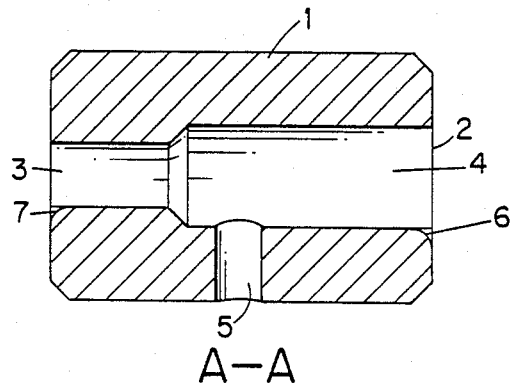
FIG. 2 represents a sectional view of the air jet in FIG. 1 along reference line A—A.
Figure 3:
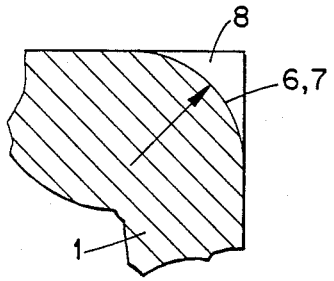
FIG. 3 is an enlarged sectional view of a rounded slot embodiment.

At the yarn contact point of each end are provided a slot 6 and slot 7 shown in enlarged detail in FIG. 3, slots 6 and 7 in this embodiment are formed with a radial curvature. The side 8 of the slot is shown straight, but may itself be curved or angled (see, e.g., FIG. 6). Slots 6 and 7 are aligned on the same side of bore 4 as the vertical air inlet 5 (reference cross section A—A in FIGS. 1 and 2).

The air jet body may be made from any conventional material suitable for such devices. Type 316 stainless steel may, for example, be the material of construction. The details of the jet may be machined from bar stock or cast. The jet housing may also be made from a number of ceramic materials, known for their hardness and abrasion resistance. In the latter instance, the details may be molded into green or unfired units. The slots 6 and 7 may be formed in the green state or cut before firing.

Figure 4:
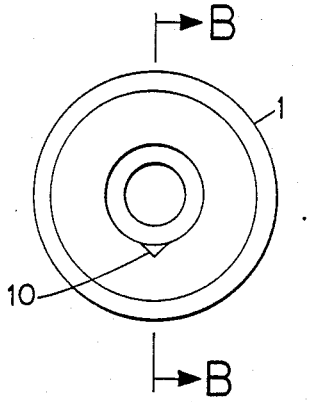
FIG. 4 represents an end view of a fluid jet design incorporating another embodiment of the invention.
Figure 5:
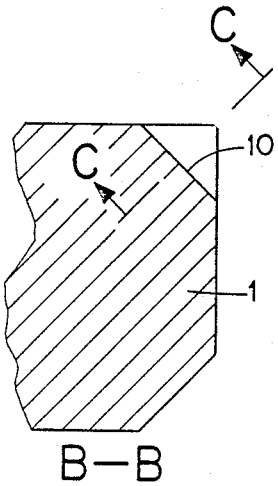
FIG. 5 and FIG. 6 show details of the notch embodiment of FIG. 4.
Figure 6:
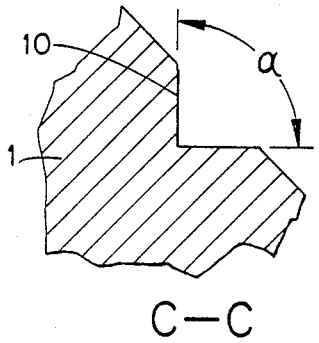

The notch embodiment in FIGS. 4 to 6 comprises a straight notch 10 of substantially 45°×90°. This embodiment is more easily formed in, for example, a green ceramic jet before firing.

EXAMPLE 1

An air jet stock is formed from aluminum oxide ceramic material having the configuration shown in FIG. 2. The housing diameter is $\frac{3}{4}''$ and is 1″ in length. The two yarn passage inner diameters are $\frac{1}{4}''$ and $\frac{3}{8}''$. A $\frac{1}{8}''$ air inlet is as shown in FIG. 2. However, no notch is placed in the inlet and exit sections of the yarn passage.

A second air jet is constructed in the same manner, but notches of 45°×90° similar to that shown in FIGS. 4–6 are formed in the green material prior to firing.

Two ends of 2,200 denier nylon yarn, each having 112 filaments, are passed through the first jet, with the jet having air at 110 PSIG being fed to it. The inlet tension on the yarns is 75–125 g. The yarns are passed through the jet at 500 ypm.

The above test is repeated with the second jet (notched) using the same conditions. The entanglement nodes (see U.S. Pat. No. 4,223,520) with jet 1 (no notch) averages 30/meter. The entanglement nodes of the yarns through jet 2 (45°×90° notch) averages 35/meter. Surprisingly, a 17% increase in entanglement (# of nodes per meter) is obtained under the same processing conditions through the use of the 45°×90° notches.

EXAMPLE 2

An air jet body similar to jet 1 in Example 1 was constructed, but slots as in FIG. 1 and 2 are added. Two ends of nylon yarn are passed through the jet under conditions set out in Example 1. The entanglement of these yarns averages 33 nodes/meter or an increase of 10% over jet 1 in Example 1.

The improvement in entanglement in Examples 1 and 2 does not reflect a more difficult to characterize improvement in consistency and uniformity noted in carpets made from yarns passed through the notched jets. Further, the increase in life expectancy and point to point uniformity of the notched jets has made this significant improvement in the end product possible.

I claim:

1. An apparatus for entangling filaments of synthetic yarns, comprising:

(a) a housing;

(b) a yarn passageway through said housing comprising a larger diameter cylindrical bore concentric with and abutting a cylindrical bore of smaller diameter;

(c) a fluid passage through said housing intersecting the larger bore of the yarn passageway perpendicularly, said fluid passage being cylindrical and of lesser diameter than said larger yarn passage bore;

(d) a slot or notch at each end of the yarn passageway where the yarn will contact the entrance and exit areas of the passageway, each said slot or notch aligned on the same side of the yarn passageway as the fluid passage.

2. The filament entangling apparatus of claim 1 wherein the inlet and exit slots or notches have a radial curvature.

3. The filament entangling apparatus of claim 2 wherein the sides of each slot or notch are straight.

4. The filament entangling apparatus of claim 2 wherein the sides of each slot or notch are angled or curved.

5. The filament entangling device of claim 1, wherein each said slot or notch comprises a straight notch of substantially 45°.

6. The filament entangling device of claim 5 wherein said 45° notch has angled sides, the angle between the sides being about 90°.

* * * * *